US009694964B2

(12) United States Patent
McCormick

(10) Patent No.: US 9,694,964 B2
(45) Date of Patent: Jul. 4, 2017

(54) SYSTEM AND METHOD FOR TRANSPORT OF TEMPERATURE SENSITIVE MATERIALS

(71) Applicant: SAVSU Technologies LLC, Old Bethpage, NY (US)

(72) Inventor: Bruce McCormick, Santa Fe, NM (US)

(73) Assignee: Barson Composites Corporation, Old Bethpage, NY (US)

( * ) Notice: Subject to any disclaimer, the term of this patent is extended or adjusted under 35 U.S.C. 154(b) by 303 days.

(21) Appl. No.: 13/847,244

(22) Filed: Mar. 19, 2013

(65) Prior Publication Data

US 2013/0240537 A1 Sep. 19, 2013

Related U.S. Application Data

(60) Provisional application No. 61/612,598, filed on Mar. 19, 2012.

(51) Int. Cl.

| | |
|---|---|
| ***F25D 23/00*** | (2006.01) |
| ***B65D 81/38*** | (2006.01) |
| ***F25D 3/08*** | (2006.01) |

(52) U.S. Cl.

CPC ..... *B65D 81/3888* (2013.01); *F25D 3/08* (2013.01); *F25D 2303/0845* (2013.01); *F25D 2331/809* (2013.01)

(58) Field of Classification Search

CPC .. B65D 81/3888; B65D 81/383; B65D 81/18; B65D 5/0005; B65D 21/08; F17C 13/06; Y10S 220/901; F25C 1/24; B01L 2300/1883; A47J 41/0088; F25D 3/08

USPC ..... 220/592, 592.01, 592.2

See application file for complete search history.

(56) References Cited

U.S. PATENT DOCUMENTS

| | | | | |
|---|---|---|---|---|
| 1,808,833 A * | 6/1931 | Brack | 229/101 |
| 2,166,560 A * | 7/1939 | Schmelzer | 249/66.1 |
| 2,340,676 A * | 2/1944 | Mallard | 249/77 |
| 3,238,002 A * | 3/1966 | O'Connell et al. | 312/400 |
| 3,494,726 A * | 2/1970 | Barasch | 422/29 |
| 4,755,064 A | 7/1988 | Weber | |
| 4,923,077 A * | 5/1990 | Van Iperen et al. | 206/527 |
| 5,435,142 A * | 7/1995 | Silber | 62/60 |
| 5,858,263 A * | 1/1999 | Geary | 249/120 |

(Continued)

FOREIGN PATENT DOCUMENTS

JP 2011046449 A 3/2011

OTHER PUBLICATIONS

International Search Report for PCT/US2013/032938, dated Jul. 10, 2013, 3 pages.

(Continued)

*Primary Examiner* — Anthony Stashick
*Assistant Examiner* — James M Van Buskirk
(74) *Attorney, Agent, or Firm* — Reising Ethington P.C.

(57) ABSTRACT

A transport system for temperature sensitive materials includes a contents container and one or more thermal batteries in a stacked relationship in a thin-walled, flexible transport sleeve. The sleeve facilitates insertion and removal of the contents with respect to a thermally insulated container. The sleeve can be closed with a tamper-evident closure and may also be transparent to allow an observer to view indicia on the contents container indicating the temperature-sensitive nature of the contents.

20 Claims, 2 Drawing Sheets

(56) References Cited

U.S. PATENT DOCUMENTS

| | | | | |
|---|---|---|---|---|
| 6,020,575 | A * | 2/2000 | Nagle et al. | 219/432 |
| 6,033,762 | A * | 3/2000 | Decker | 428/201 |
| 6,128,915 | A * | 10/2000 | Wagner | 62/457.3 |
| 6,308,518 | B1 | 10/2001 | Hunter | |
| 6,427,475 | B1 * | 8/2002 | DeFelice | F25D 3/08 62/457.2 |
| 2002/0130131 | A1 * | 9/2002 | Zucker et al. | 220/592.2 |
| 2006/0191282 | A1 | 8/2006 | Sekiya et al. | |
| 2008/0135564 | A1 | 6/2008 | Romero | |
| 2008/0205799 | A1 * | 8/2008 | Sendra | 383/70 |

OTHER PUBLICATIONS

Written Opinion for PCT/US2013/032938, dated Jul. 10, 2013, 7 pages.

* cited by examiner

SYSTEM AND METHOD FOR TRANSPORT OF TEMPERATURE SENSITIVE MATERIALS

This application claims the benefit of Provisional Application No. 61/612,598, filed Mar. 19, 2012, the entire contents of which are hereby incorporated by reference.

TECHNICAL FIELD

The present disclosure relates generally to systems and methods for handling temperature sensitive materials.

BACKGROUND

Temperature sensitive materials are materials that may lose beneficial properties or functions when they reach a temperature outside a particular temperature range. Examples of temperature sensitive materials include certain pharmaceutical materials, such as drugs, medicines, or other medical treatments. Pharmaceuticals such as biopharmaceuticals can include "living" substances such as proteins, enzymes, or other biologically active components and may irreversibly lose beneficial properties if not kept within the appropriate temperature range—i.e., once biological activity is lost, it sometimes cannot be regained. Such materials tend to be very costly, making their loss through temperature damage an expensive loss. These losses may impact patient health or recovery such as when the pharmaceutical user is unaware of the temperature damage and the pharmaceutical is used without the desired effect. The high cost of some temperature sensitive pharmaceuticals has led to counterfeiting, theft, and other tampering during transport. The high cost of material loss may also provide incentive for custodians along the chain-of-custody, from initial packaging to final delivery, to pass along materials that have fallen outside the specified temperature range in order to avoid cost liability.

SUMMARY

In accordance with one embodiment, a transport system for temperature sensitive materials includes a contents container having a storage area for temperature-sensitive items and a thermal communication surface. The system further includes a thermal battery container having a thermal mass storage area and a thermal communication surface. The system further includes a thin-walled transport sleeve constructed from a flexible material and having an open end for receiving the contents container and the thermal battery container in a stacked relationship with the respective thermal communication surfaces of the containers in contact with each other. The sleeve is sized to constrain the containers in the stacked relationship, and the open end is closable with a tamper-evident closure.

In accordance with another embodiment, a transport system for temperature sensitive materials includes a contents container having a storage area for temperature-sensitive items and top and bottom thermal communication surfaces. The system further includes first and second thermal batteries in a stacked relationship with the contents container. Each thermal battery includes thermal mass inside a thermal battery container, and each thermal battery container has a top or bottom thermal communication surface in contact with one of the thermal communication surfaces of the contents container. The system further includes a transport sleeve enclosing the contents container and the thermal batteries in the stacked relationship. The sleeve is shaped to support the stacked containers from the bottom of the stack and has an upper handle for manual transport of the stacked containers into and out of a thermally insulated storage container. The sleeve is sized to constrain the containers in the stacked relationship. The system also includes a tamper-evident closure that assists the transport sleeve with enclosing the contents container and thermal batteries.

In accordance with another embodiment, a method of transporting temperature sensitive materials includes the steps of: (a) stacking a contents container and one or more thermal batteries one on top of one another through an open end of a flexible transport sleeve sized to constrain the container and the one or more batteries in a stacked arrangement, the contents container having temperature sensitive materials stored therein; (b) closing the open end of the sleeve with a tamper-evident closure, thereby enclosing the contents container and the one or more thermal batteries in the sleeve; and (c) placing the closed sleeve into a thermally insulated container to be delivered at a delivery location.

BRIEF DESCRIPTION OF THE DRAWINGS

One or more preferred exemplary embodiments will hereinafter be described in conjunction with the appended drawings, wherein like designations denote like elements, and wherein.

DETAILED DESCRIPTION OF ILLUSTRATIVE EMBODIMENTS

As described below, temperature sensitive materials can be stored, transported, and/or delivered in a manner that reduces the risk of temperature damage to the materials. A stacked arrangement of containers can physically isolate the sensitive materials from cold packs or other thermal mass while maintaining controlled inter-container thermal communication. A transport sleeve can be sized to constrain the containers in the stacked arrangement during transport and other handling and can facilitate insertion and removal of the containers from a reusable thermally insulated storage container.

Figure 1:
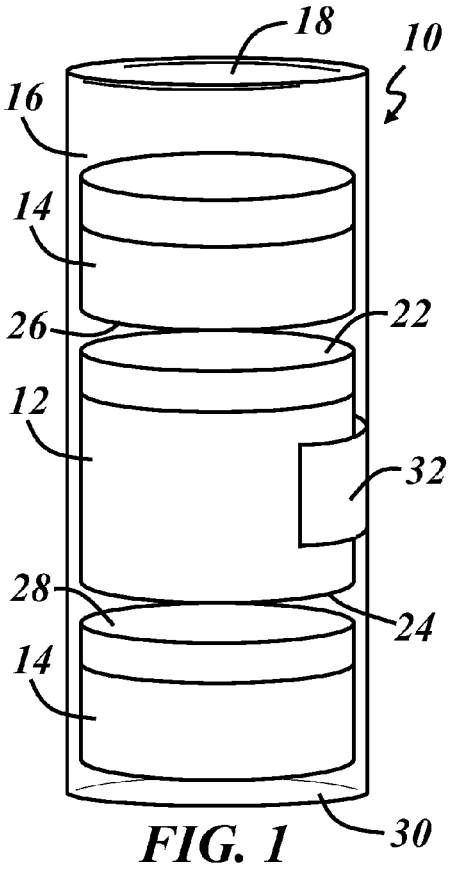
FIG. 1 is an illustration of one embodiment of a transport system for temperature sensitive materials, including a transport sleeve with an open end.
Figure 2:
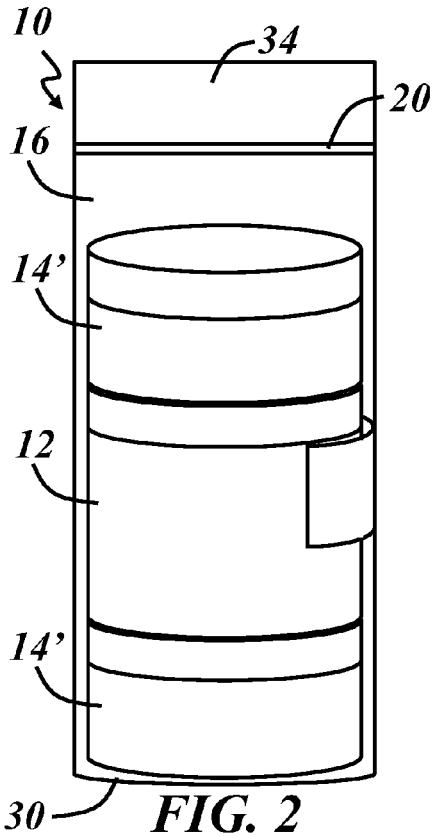
FIG. 2 is an illustration of the transport system of FIG. 1, including a tamper-evident closure.

FIGS. 1 and 2 illustrate an example of a transport system 10 for temperature sensitive materials, including a contents container 12, thermal battery containers 14, and a transport sleeve 16. FIG. 1 shows the system 10 as it may be supplied in kit form, where containers 12, 14 may be empty and sleeve 16 includes an open end 18 for insertion of the containers after they are filled. FIG. 2 shows the system 10 ready for transport, with a tamper-evident closure 20 helping to enclose the containers in the sleeve 16 after temperature sensitive materials are placed in the contents container 12 and thermal mass (e.g., water or other phase-change material) is placed in the thermal battery containers to form thermal batteries 14'. The thermal batteries 14' may also be supplied as sealed units at least partly filled with thermal mass. In the illustrated embodiment, where the contents container 12 is configured to be stacked between two thermal batteries 14', top and bottom thermal communication surfaces 22, 24 of the contents container are configured for respective contact with a bottom thermal communication surface 26 of one thermal battery container and a top thermal communications surface 28 of the other thermal battery container. Thermal communication surfaces are subsequently described in further detail.

As shown, the system 10 may be somewhat modular in nature with identical thermal battery containers 14 configured for arrangement above and below the contents container 12 in a stacked arrangement. FIGS. 1 and 2 illustrate only one example of a stacked arrangement, as any number of thermal batteries 14' may be stacked together with any number of contents containers 12. For example, other embodiments may include a single thermal battery arranged to be stacked on top of or beneath a contents container so that only one of the thermal communication surfaces of the contents container is in contact with a thermal battery. In the context of pharmaceutical contents where the contents may be kept within a temperature range from about 2° C. to about 8° C., the stacked arrangement of FIGS. 1 and 2 may be particularly useful where the anticipated ambient environment during transport is about 20° C. or higher and the thermal mass is frozen water. But a single thermal battery may be sufficient or preferable at ambient transport temperatures of about 25° C. or lower. For instance, at an ambient transport temperature in a range from about 15-25° C., the stacked arrangement may include a single ice-containing thermal battery stacked above the contents container. In another embodiment, with an anticipated ambient transport temperature in a range from about 5° C. to about 20° C., the stacked arrangement can include a single ice-containing thermal battery stacked below the contents container. Thus, a configuration for the stacked arrangement may be selected based on the ambient conditions expected during transport.

In another embodiment, the thermal battery containers 14 intended for use above and below the contents container 12 in the stacked arrangement are not identical in size and/or in the amount of thermal mass placed therein. For example, due to the natural tendency for convective thermal energy to rise in the atmosphere, it may be desirable that the thermal battery container 14 positioned above the contents container 12 in the stack be larger than the battery container positioned beneath the contents container. Or the containers 14 may be the same size, but the thermal battery above the contents container may include more thermal mass than the thermal battery therebelow. This can allow for configurations in which thermal mass both above and below the contents container remain in a solid or phase-change state for approximately the same amount of time, even though the thermal energy being transferred to the top thermal battery is higher than the energy being transferred to the bottom thermal battery during use.

The illustrated transport sleeve 16 is provided with open end 18 for receiving the contents container 12 and thermal battery container(s) 14. Opposite end 30 is a closed bottom end of the sleeve in this embodiment and supports the stacked containers from the bottom of the stack when the sleeve 16 is lifted during handling. The sleeve 16 is sized to constrain the stacked containers in a stacked arrangement when the containers are in the sleeve. In the illustrated embodiment, the contents container 12 and the two thermal battery containers 14 are cylindrical with approximately equal diameters. In order for the sleeve 16 to constrain the containers in the desired stacked arrangement shown and thereby maintain the desired contact between container thermal communication surfaces, the sleeve is sized to have a close fit with the diameter of the containers. In other words, the sleeve has a cross-section between its ends 18, 30 large enough to accommodate the containers, but small enough so that the individual containers cannot readily shift out of the stacked arrangement. In one embodiment, the sleeve is a plastic bag and may be provided in flat form with a width in the flat that is slightly larger than half of the perimeter (e.g. circumference) of the containers 12, 14.

The transport sleeve 16 may be a non-insulative sleeve. While all materials provide some inherent amount of resistance to thermal energy transfer therethrough, the term "non-insulative" is used herein to describe a transport sleeve made from a material having a thermal conductivity (X) greater than 0.1 W/m-K. This includes, for example, any sleeve made from a plastic material that has not been foamed, expanded, or otherwise infiltrated with dissolved gases during processing. Some examples of suitable materials for the non-insulative sleeve are high-density polyethylene (HDPE), low-density polyethylene (LDPE), linear low-density polyethylene (LLDPE), and polypropylene (PP). In one non-limiting example, the sleeve material is a spun and bonded polyolefin material such as Tyvek (Dupont, Wilmington, Del.). Non-polymeric material may be used as well, such as textile materials, metal foils, or materials including woven metal or glass fibers, for example. The sleeve may be thin-walled and/or be constructed from a flexible material. For example, the sleeve may be constructed from a plastic film material having a thickness in a range from about 0.001 inches to about 0.008 inches (1-8 mils). In another embodiment, the sleeve is constructed from a plastic film material having a thickness in a range from about 0.002 inches to about 0.004 inches (2-4 mils).

According to one embodiment, the transport sleeve 16 may have a maximum R-value of about 0.5 $m^2$-K/W, whether the sleeve is constructed from an insulating material or a non-insulating material. The R-value is defined as the sleeve wall thickness divided by the thermal conductivity of the sleeve material ($R=t/\lambda$). For instance, the transport sleeve may be constructed with an insulating material in situations where the transport system will be handled and transferred from one thermally insulated storage container to another during transport or custodial exchange. By way of example, a 1 mm thick sleeve made from an insulating material with a thermal conductivity of $\lambda \approx 0.05$ W/m-K would have an R-value of about 0.02 $m^2$-K/W, whereas a typical styrofoam cooler with a 50 mm wall and $\lambda \approx 0.03$ W/m-K would have an R-value of about 1.7 $m^2$-K/W. Thus, the R-value may be used to distinguish a relatively thin transport sleeve from a conventional insulated container with a relatively large wall thickness. One example of a material and thickness combination having an R-value of about 0.5 $m^2$-K/W is a transport sleeve made from a flexible, foamed polymeric material with a wall thickness of about ½" (12.7 mm) and a thermal conductivity of $\lambda \approx 0.02$-0.03 W/m-K. In one embodiment, the transport sleeve is constructed from a foamed polyolefin material that is relatively flexible and has a thickness of about ⅛" (3.2 mm) and an associated R-value of less than 0.5 $m^2$-K/W. An example of a non-insulative transport sleeve R-value is a polyethylene film sleeve with a thermal conductivity of $\lambda \approx 0.4$ W/m-K and a 4 mil thickness so that the R-value is about $2\times10^{-4}$ $m^2$-K/W.

Transport sleeve 16 may have other useful characteristics as well. For example, the sleeve may be at least partially transparent so that an observer can see the containers 12, 14 through the sleeve. This characteristic may be useful to communicate to the observer the temperature-sensitive nature of the system contents via indicia included on container outer surfaces, for example. Alternatively, or in addition, the sleeve itself may include such indicia and/or an indicia area 32 for a user to add information to the outside of the sleeve, such as a writable area or an area for applying adhesive labels. Area 32 may be used to apply information such as patient identification information, contents information, instructions for storage and/or use of the contents, container disposal instructions, etc. In one embodiment, only a portion of the sleeve is transparent so that a portion of the stacked arrangement of containers may be viewed therethrough. For example, an insulating transport sleeve or some other type of opaque sleeve may include a transparent or semi-transparent film window.

The sleeve 16 may also include a handle 34, as shown in FIG. 2 for example. The handle 34 may comprise additional sleeve material located above the top of the stacked containers, or it may comprise a separately applied handle, openings formed through the sleeve material near the open end, or other some other portion useful for manually lifting or handling the containers while in the sleeve. The sleeve 16 may also be closable with a tamper-evident closure 20 as shown in FIG. 2. The tamper-evident closure 20 in this example is a heat-sealed portion of the sleeve, thus the sleeve 16 provided in FIG. 1 for loading the containers is constructed from a heat-sealable material such as a polyethylene material or other thermoplastic. Other tamper-evident closures may be provided, such as tamper-evident tape or any other type of closure that is visibly and irreversibly changed when the sleeve is reopened.

Figure 3:
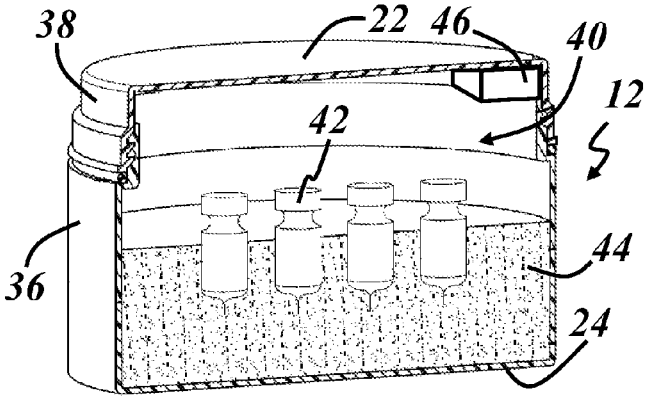
FIG. 3 is a cross-sectional view of a contents container, according to one embodiment.
Figure 4:
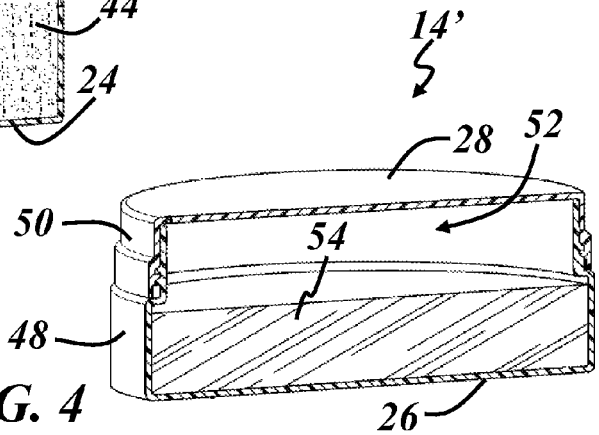
FIG. 4 is a cross-sectional view of a thermal battery, according to one embodiment.

FIGS. 3 and 4 are cross-sectional views of an illustrative contents container 12 and an illustrative thermal battery 14'. Referring to FIG. 3, the contents container 12 includes a body 36 and a cover 38 that together define an internal contents storage area 40 where temperature-sensitive contents 42 can be temporarily stored for transport and/or delivery. As shown, the cover 38 may be removably attached to the body 36 by way of a threaded connection, but other attachments are possible. For instance, it is not necessary that the cover 38 be fully removable, as it is sufficient that the cover 38 is able to move with respect to the body enough to provide access to the contents storage area 40 so that the temperature sensitive contents 42 can be placed therein and removed therefrom. This particular embodiment includes a foam insert 44 that isolates the contents 42 from the body 36 and cover 38 and stabilizes the position of the contents 42 within the container 12 during transport.

In the illustrated embodiment, the body 36 includes the bottom thermal communication surface 24, and the cover 38 includes the top thermal communication surface 22, each surface being provided for thermal communication with a thermal battery when stacked therewith. One or both thermal communication surfaces 22, 24 may be the entire flat top and bottom surfaces of the container 12 as shown, or the top and/or bottom of the container can include one or more depressions or recesses (not shown). For example, a round depression or recess located in the center of the cover or body can limit the thermal communication surfaces 22, 24 to annular portions of the top and bottom of the container. Thus the surface area of each thermal communication surface can be specifically pre-determined and designed into the container 12 by appropriately sizing the recess. The same can be said for the thermal communication surfaces of the thermal batteries.

The size of the thermal communication surface areas of the contents and thermal battery containers can be used to optimize the thermal energy transfer rate between the contents container and the thermal batteries. For example, each thermal communication surface may be sized with a surface area that allows a thermal energy transfer rate from the contents container 12 to the thermal batteries that is balanced with the predicted thermal energy transfer rate into the contents container storage area through the other surfaces of the contents container (i.e., the container sidewalls). If the surface areas of the respective thermal communication surfaces are too small, the contents storage area may become too warm; and if the surface areas of the respective thermal communication surfaces are too large, the contents storage area may become too cold.

Though not shown in FIG. 3, an additional tamper-evident closure may be used with the contents container 12 for redundancy and additional protection against theft and/or counterfeiting activity. Examples of tamper-evident closures include tamper-evident tape (e.g. at the body-to-cover joint), heat seals, mechanical locks, and one-way covers or tops. The contents container 12 may also include a device 46 for collecting data, communicating data, or both. Some examples of data collection devices include a GPS receiver, a thermocouple or other temperature sensor, a humidity sensor, an accelerometer, or a timer. Any of these data collection devices may also include electronic memory or some other type of storage device to record the relevant data over time while the system is being transported, thereby providing a history of the location and conditions the system experienced during transport.

The device 46 may also include communication capability, whether via electrical connection, wireless connection, or audio-visual means. For example, the device 46 may be attached to a computer after delivery for communication of time-logged data to the computer for storage or analysis. Or the device may include a wireless transmitter to transmit data for receipt by another electronic device. The device 46 may be a thermometer with a visual readout on the outside of the container, thereby transmitting information by visual means. In one embodiment, the device is an electronic ID tag that can be wirelessly scanned through the container by a scanner that receives stored information about the contents or the history of the contents container during transport. It is to be understood that device 46 may represent multiple devices that each perform one or more different functions, and that such device or devices may be attached to the transport sleeve or some other system component. As part of an empty transport system, one or more of the system components may simply include an attachment location designed to removably accommodate the device or devices.

Referring now to FIG. 4, the illustrative thermal battery container (shown in thermal battery form as 14') includes body 48 and cover 50 that together define an internal thermal mass storage area 52 where thermal mass 54 can be stored to provide additional heat capacity to the system. Body 48 includes the bottom thermal communication surface 26, and cover 50 includes the top thermal communication surface 28. In this embodiment, cover 50 is removably attached to body 48 by way of a threaded connection. As with the contents container, it is sufficient that the cover 50 be able to move with respect to the body 48 only enough to provide access to the thermal mass storage area 52 so thermal mass 54 can be placed therein and removed therefrom. One particular embodiment includes water as the thermal mass 54, illustrated in solid or frozen form in FIG. 4 as ice. The thermal mass 54 need not be removable in all cases. Some embodiments of the thermal battery include the desired thermal mass hermetically sealed within the thermal battery container and can thus be reused and never require refilling.

With a thermal battery as shown, in which the thermal mass is intended to be removable, the body 48 can be partly filled with liquid water, covered with cover 50, and placed in a freezer to solidify the water to form thermal battery 14' for use with the transport system. Eventually, through various modes of thermal energy transfer during and/or after use, the solid thermal mass changes back to liquid water, after which cover 50 can removed and the water can be safely disposed of. In one embodiment, the contents container and/or the thermal battery container(s) are made from a recycled and/or recyclable plastic such as a polyethylene or polypropylene plastic for environmentally friendly disposal after use. Though in some applications, water may be the preferred thermal mass for non-hazardous disposal, the thermal battery may additionally or alternatively include other types of thermal mass and/or phase change materials such as heavy water ($D_2O$) or gel packs, and in some cases the thermal battery container cannot be opened.

Figure 5:
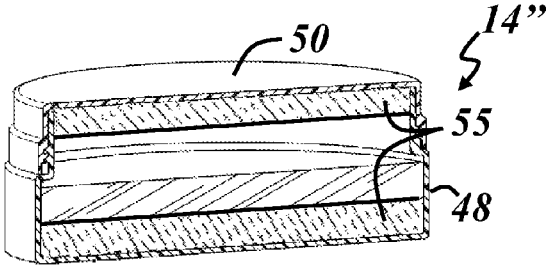
FIG. 5 is a cross-sectional view of the thermal battery, according to another embodiment.

In another embodiment, the thermal battery includes one or more layers of insulating or super-insulating material. For example, FIG. 5 illustrates a thermal battery 14" with one insulating layer 55 attached to the body 48, and another attached to the cover 50. In this example, each insulating layer 55 is attached within the thermal mass storage area—i.e., one at an inner surface of the cover 50 and one at the bottom inner surface of the body 48. The insulating layer 55 provides an additional element useful for configuring the transport system to have known and pre-determined thermal energy transfer rates from container to container. As used herein, an insulating material is any material having a thermal conductivity of 0.1 W/m-K or less. A super-insulating material is any insulating material having a thermal conductivity of less than 0.02 W/m-K.

The transport system may include thermal batteries with only one insulating layer at either the top (cover) or bottom (body) of the thermal mass storage area, in which case the insulating layer 55 is positioned within the thermal battery container at either the top or bottom so that it is closest to the contents container when placed in the stacked arrangement. For example, a thermal battery intended for use beneath the contents container when stacked may have the insulating layer 55 attached to the cover 50, while a thermal battery intended for use over the contents container when stacked may have the insulating layer 55 attached at that bottom of the body 48. With a modular system, for example, bodies 48 and covers 50 may be interchangeable so that each can be selected to have an insulating layer 55 or not, depending on the intended location in the stacked arrangement.

The insulating layer(s) 55 may be attached in the thermal battery container by any suitable means, such as press-fit, adhesive, or snap-in. In one embodiment, the thermal battery container is provided as part of a transport system with the insulating layer 55 attached inside the body of the battery container, and liquid thermal mass such as water is placed in the body to be solidified for use so that the insulating layer 55 is embedded in the frozen thermal mass. The insulating layer(s) may be constructed from any insulating material suitable for use in and/or around the intended thermal mass. Polyurethane foam and aerogel materials are examples of suitable materials for insulating layer 55.

Figure 6:
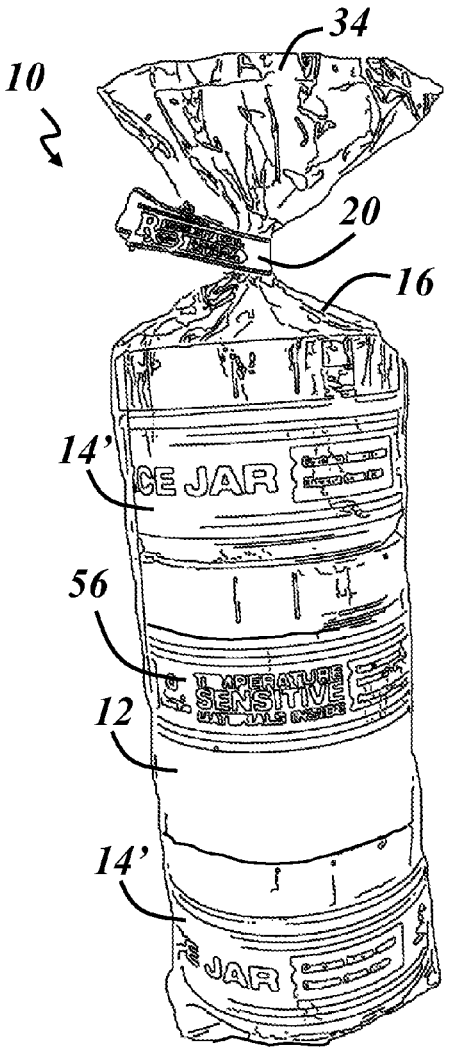
FIG. 6 is an illustration of another embodiment of the transport system, including a tamper-evident tape closure.

FIG. 6 shows one embodiment of the closed transport system 10 with a tamper-evident closure 20 different from that of the system illustrated in FIG. 2. In the embodiment of FIG. 6, the tamper-evident closure 20 includes tamper-evident tape wrapped around a bunched portion of the transport sleeve 16. In other words, the portion of the transport sleeve 16 extending above the stacked containers is bunched together and optionally twisted, and the tape is wrapped around the sleeve where it is bunched. In this embodiment, the portion of the sleeve 16 located above the bunched and tamper-evident closure 20 serves as a handle 34 for the system. Also shown in this embodiment are indicia 56 printed or adhered to the contents container 12. The indicia 56 in this example serve to communicate information to an observer regarding the temperature-sensitive nature of the contents. It may be printed in bold, large, and/or bright lettering to draw attention from observers. While providing prominent warning or other urgent messages on containers may be conventional, the indicia 56 in combination with a sleeve 16 that is at least partially transparent serves an additionally useful function in the context of temperature sensitive material transport, delivery, and storage. The indicia 56 may be effective to reduce or eliminate the false sense of security provided by certain other types of delivery containers such as styrofoam coolers. In other words, the method for delivery of the system 10, examples of which are described below, may include intentionally exposing the contents container 12 and its indicia 56 to ambient conditions at the delivery location to draw attention to the system 10, thereby making it more likely that an observer will take appropriate action, such as transporting the system 10 to a local storage area maintained at a safe temperature.

This is an unconventional delivery step made possible by the thermal batteries stacked together with and constrained in position with the contents container. In a conventional delivery scenario for temperature-sensitive materials such as pharmaceuticals, an observer may see a styrofoam container and decide not to take any action to protect the contents, despite any indicia that warns the observer about the temperature sensitive nature of the contents. This may be because the observer associates the bulky styrofoam material with temperature safety, thus increasing the probability that he will believe the contents are and will remain at a safe temperature longer than they actually will. This increased probability of delayed action also increases the probability that the observer will forget about the delivery and wait too long to take appropriate action. Transport system 10, in the absence of a bulky insulated container, is more likely to receive prompt attention while also maintaining the temperature sensitive materials at a safe-temperature. As shown, the system 10 may include additional indicia, for example with the tamper-evident tape at the closure 20 or with the thermal batteries.

Figure 7:
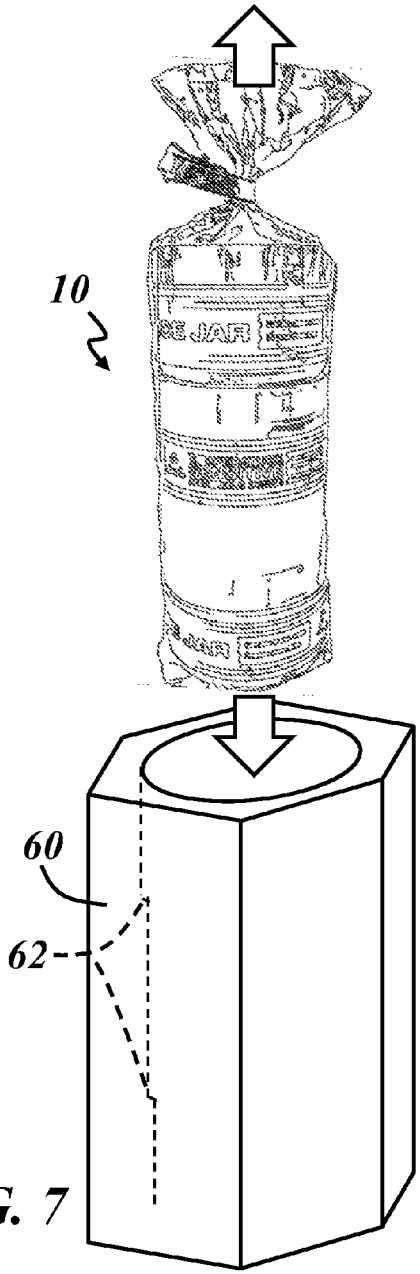
FIG. 7 is an illustration of the transport system of FIG. 6 shown with a thermally insulated storage container for transport to a delivery location.

FIG. 7 shows the transport system 10 with a thermally insulated container 60. The arrows in the figure indicate the directions in which the system 10 may be inserted or extracted from the container 60. The insulated container 60 is sized to receive the transport system 10. In one embodiment, the transport system is provided in kit form including the insulated container 60. Insulated container 60 includes insulated or super-insulated walls (including a top or lid not shown) that surround the transport system 10 and serves to reduce or minimize thermal energy transfer between the external environment and its contents. As a part of the system and methods described herein, the insulated container is employed after the contents container and thermal batteries are enclosed in the transport sleeve and at least until delivery. An additional feature of the transport system 10 when combined with the insulated container 60 is minimization or elimination of condensation within the thermally insulated container. For example, condensation may form on the exterior of thermal batteries with cold thermal mass such as ice when exposed to the ambient environment, especially in humid environments. When enclosed in the transport sleeve, such condensation is also enclosed and kept away from the interior surfaces of the thermally insulated container 60. Where the method of transport and/or delivery includes reuse of the insulated container, keeping the interior surfaces of the container 60 dry is useful to prevent unwanted microbial growth. This can be particularly useful when transporting pharmaceuticals, where sanitary conditions are preferred. Likewise, the transport sleeve may serve to contain any spills or leaks from any of the enclosed containers with similar advantages.

An optional feature of the thermally insulated container 60 is a stack configuration feature 62, as indicated in dashed lines in the figure. The particular configuration feature 62 shown is a stepped feature at the inner wall of the container 60 in which the portion of the stepped feature at the bottom of the container 60 is slightly smaller than the portion thereabove. In the particular example shown, the inside of the thermally insulated storage container 60 is sized to fit only gradually larger containers from the bottom to the top of the stacked arrangement of the transport system. This may be useful when the thermal batteries above and below the contents container are sized differently (e.g., with more thermal mass above the contents container), or when there is a single thermal battery and it is desired to specifically locate the thermal battery either above or below the contents container depending on the ambient environment. Thus, where a particular thermal battery should be located within the stacked arrangement so that it is below the contents container, the particular thermal battery container may be constructed so that it is the only container in the stack that will fit at the bottom of the thermally insulated container 60. Likewise, the contents container and the thermal battery container for arrangement above the contents container may be sized so that they cannot be accidentally reversed during packaging. More specifically, a transport system 10 that has been improperly stacked will not fit into a thermally insulated container constructed with feature 62. The differences in the sizes of the stacked containers may be sufficiently small so that the fit of the transport sleeve is sufficient to constrain the containers in the stacked arrangement. For example, a container in the stack to be arranged above another container may be about ⅛" larger than the other so that it is excluded from lower portions of the thermally insulated container by feature 62.

According to one embodiment a method of transporting temperature sensitive materials, includes the steps of: (a) stacking the contents container, with pharmaceutical materials stored inside, together with one or more thermal batteries into the open end of the transport sleeve; (b) closing the open end of the sleeve with a tamper-evident closure to enclose the contents container and thermal battery or batteries in the sleeve; and (c) placing the closed sleeve into the thermally insulated container to be delivered at a delivery location. The method may further include using a tamper-evident closure on the thermally insulated container, the contents container, or both.

After the closed sleeve is placed in the thermally insulated container, it may be transported from the packaging location to the delivery location via ground or air transportation, for example. The method may further include removing the closed sleeve from the thermally insulated container at the delivery location. This may be performed by delivery personnel at the delivery location or by personnel receiving the delivery. Conventional methods of preserving the chain of custody may be employed, such as each different custodian who takes possession of the system inspecting the tamper evident closure(s) and/or verifying other system information on receipt and certifying by signature that the system has not been compromised while in his possession when the next person receives the system from him. In one embodiment, the delivery personnel removes the transport system, including the contents container stacked with thermal batteries in the transport sleeve, from the thermally insulated container and transfers possession of the system to a different person or to a particular designated location at the delivery location. In this particular embodiment, the insulated container may then be returned for reuse and receive another, different sleeved-transport system. As previously described, removing components from the insulated container for delivery is unconventional, but can provide the advantage of a visual incentive for the recipient to take action to protect the temperature sensitive materials. However, in some other embodiments, the insulated container may be delivered with the transport system inside. For example, some delivery locations may be known to experience delays in action to protect the materials, and other locations may be waypoints along the route to the final delivery location. The insulated delivery container may be returned for reuse at a later time, such as at the time of another delivery.

An additional optional feature that can facilitate reuse of system components is the use of a transport sleeve that includes a contents container removal area that allows for removal of the contents container from the stacked arrangement of containers without disturbing the thermal battery or batteries. For example, the transport sleeve may include a perforated area corresponding to the location of the contents container within the stack, along with indicia that include instructions for the recipient of the system for opening the sleeve to retrieve the contents container. This may be useful so that the recipient does not have to remove the top thermal battery from the sleeve to get to the contents container. A close fit between the sleeve and the containers therein could make it difficult to remove any of the containers from the sleeve without inverting the sleeve, which could be undesirable depending on the contents. The sleeve could include indicia with markings such as "cut here," even in the absence of perforations or other easy-opening features. This can also allow the thermal batteries to be kept with the partly opened sleeve for return and reuse, or the sleeve may be recycled or otherwise disposed of.

The method may further include monitoring one or more conditions of the contents container before it reaches the delivery location, such as the temperature inside the contents container, the global location of the container, the magnitude or other characteristics of vibrations experienced by the container, etc. This may be performed using a data collection and/or data communication device as described above, for example.

In another embodiment, the transport system includes at least three layers of tamper-protection. For example, pharmaceutical materials may be stored and/or transported in the contents container with a tamper-evident closure, the contents container can be stacked in the transport sleeve with one or more thermal batteries and the sleeve can be closed with a tamper-evident closure, and the closed transport sleeve can be stored and/or transported in the thermally insulated container having a tamper-evident closure for transport to a delivery location. Each tamper-evident closure can be of a different variety to make it more difficult for a potential tamperer to eliminate the evidence tampering.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A transport system for temperature sensitive materials, the system comprising:

a contents container having a storage area for temperature-sensitive items and a thermal communication surface;

a thermal battery container having a thermal mass storage area and a thermal communication surface; and a thin-walled transport sleeve constructed from a flexible material and having an open end for receiving the contents container and the thermal battery container in a stacked relationship with the respective thermal communication surfaces of the containers in contact with each other, the sleeve being sized to constrain the containers in the stacked relationship and the open end being closable with a tamper-evident closure, wherein the flexible material has an R-value less than about 0.5 $m^2$-K/W.

2. A transport system as defined in claim 1, further comprising:

a second thermal battery container having a thermal mass storage area and a thermal communication surface for contact with the contents container when the contents container is stacked between the thermal battery containers.

3. A transport system as defined in claim 1, further comprising:

a thermally insulated storage container having a storage area for receiving the stacked containers and the sleeve.

4. A transport system as defined in claim 3, wherein the contents container is larger or smaller than the thermal battery container and the thermally insulated container includes a stack configuration feature that does not allow an improperly stacked arrangement to fit within the stacked arrangement.

5. A transport system as defined in claim 1, wherein the contents container, the thermal battery container, or both, includes indicia for communicating to an observer the temperature sensitive nature of contents of the system, and the sleeve is at least partially transparent so that the indicia is visible to the observer.

6. A transport system as defined in claim 1, wherein the thermal battery container further comprises an insulating layer.

7. A transport system as defined in claim 1, wherein the sleeve includes a handle for lifting the stacked containers and sleeve from a thermally insulated storage container and otherwise manually transporting the system from one location to another.

8. A transport system as defined in claim 1, wherein the sleeve includes a contents container removal area that allows removal of the contents container from the sleeve without removal of the thermal battery.

9. A transport system for temperature sensitive materials, the system comprising:

a contents container having a storage area for temperature-sensitive items and top and bottom thermal communication surfaces;

first and second thermal batteries in a stacked relationship with the contents container, each thermal battery comprising thermal mass inside a thermal battery container and each thermal battery container having a top or bottom thermal communication surface in contact with one of the thermal communication surfaces of the contents container;

an insulating layer located inside at least one of the thermal battery containers between the thermal mass and the contents container;

a transport sleeve enclosing the contents container and the thermal batteries in the stacked relationship, the sleeve being shaped to support the stacked containers from the bottom of the stack and having an upper handle for manual transport of the stacked containers into and out of a thermally insulated storage container, wherein the sleeve is sized to constrain the containers in the stacked relationship; and a tamper-evident closure that assists the transport sleeve with enclosing the contents container and thermal batteries.

10. A transport system as defined in claim 9, wherein the transport sleeve is constructed from a flexible material that has an R-value less than about 0.5 $m^2$-K/W.

11. A transport system as defined in claim 9, wherein the thermal mass is water and each thermal battery container includes a removable cover for insertion and removal of thermal mass.

12. A transport system as defined in claim 9, wherein the transport sleeve is a sealable plastic bag.

13. A transport system as defined in claim 9, wherein the transport sleeve is at least partially transparent so that an observer can view indicia on one or more of the containers and thereby be informed of the temperature sensitive nature of the contents of the system.

14. A transport system as defined in claim 9, wherein the tamper-evident closure is a heat-sealed portion of the sleeve or includes tamper-evident tape.

15. A transport system as defined in claim 9, further comprising a data or data transmission device.

16. A method of transporting temperature sensitive materials, comprising the steps of:

(a) stacking a contents container and one or more thermal batteries one on top of one another through an open end of a flexible transport sleeve sized to constrain the container and the one or more batteries in a stacked arrangement, the contents container having temperature sensitive materials stored therein;

(b) closing the open end of the sleeve with a tamper-evident closure, thereby enclosing the contents container and the one or more thermal batteries in the sleeve; and (c) placing the closed sleeve into a thermally insulated container to be delivered at a delivery location, whereby the contents container and the one or more thermal batteries can be lifted out of the thermally insulated container together while maintaining the stacked arrangement.

17. The method of claim 16, wherein step (a) includes selecting the location of the contents container relative to the thermal battery or batteries in the stacked arrangement based on the ambient conditions expected during transport.

18. The method of claim 16, further comprising the step of:

using a tamper-evident closure on the thermally insulated container, the contents container, or both.

19. The method of claim 16, further comprising the step of:

removing the closed sleeve from the thermally insulated container at the delivery location.

20. The method of claim 16, further comprising the step of:

monitoring one or more conditions of the contents container before it reaches the delivery location.

* * * * *